US007250711B2

(12) United States Patent
Koyama et al.

(10) Patent No.: US 7,250,711 B2
(45) Date of Patent: Jul. 31, 2007

(54) SPARK PLUG WITH INCREASED DURABILITY AND CARBON FOULING RESISTANCE

(75) Inventors: Taiji Koyama, Toyohashi (JP); Keiji Kanao, Aichi-ken (JP)

(73) Assignee: DENSO Corporation (JP)

( * ) Notice: Subject to any disclaimer, the term of this patent is extended or adjusted under 35 U.S.C. 154(b) by 0 days.

(21) Appl. No.: 11/221,918

(22) Filed: Sep. 9, 2005

(65) Prior Publication Data

US 2006/0055297 A1 Mar. 16, 2006

(30) Foreign Application Priority Data

Sep. 14, 2004 (JP) ..... 2004-267098

(51) Int. Cl.
*H01T 13/20* (2006.01)

(52) U.S. Cl. ..... 313/141; 313/118; 313/142; 313/143; 313/144; 123/143; 123/169 R; 123/169 EL

(58) Field of Classification Search ..... 313/123, 313/141–145, 118–140; 123/143, 169 R, 123/169 EL, 32, 41, 310; 445/7
See application file for complete search history.

(56) References Cited

U.S. PATENT DOCUMENTS 4,851,732 A * 7/1989 Kashiwara et al. ..... 313/141
4,914,343 A * 4/1990 Kagawa et al. ..... 313/139
D344,062 S * 2/1994 Kashiwara et al. ..... D13/127
5,952,770 A * 9/1999 Mueller et al. ..... 313/141
6,091,185 A * 7/2000 Matsubara et al. ..... 313/138
6,229,253 B1 5/2001 Iwata et al.
6,316,868 B1 * 11/2001 Ishino et al. ..... 313/141
6,531,809 B1 * 3/2003 Benedikt et al. ..... 313/143
6,552,476 B1 * 4/2003 Hanashi et al. ..... 313/141
6,831,397 B2 * 12/2004 Kanao et al. ..... 313/141

FOREIGN PATENT DOCUMENTS

JP 3140006 12/2000

* cited by examiner

*Primary Examiner*—Joseph Williams
*Assistant Examiner*—Hana Asmat Sanei
(74) *Attorney, Agent, or Firm*—Nixon & Vanderhye PC

(57) ABSTRACT

A spark plug for an internal combustion engine is provided which includes a metal shell, a porcelain insulator, a center electrode, a main ground electrode, and auxiliary ground electrodes. Each of the auxiliary ground electrodes has an inner side surface facing the center electrode through the porcelain insulator to define an auxiliary spark gap between itself and a nose of the porcelain insulator so as to occupy a minimum distance between the porcelain insulator and the auxiliary ground electrode. This avoids a great local increase in electrical field strength on the auxiliary ground electrode to minimize excessive discharge within the auxiliary spark gap to enhance carbon fouling resistance and durability of the spark plug.

19 Claims, 8 Drawing Sheets

SPARK PLUG WITH INCREASED DURABILITY AND CARBON FOULING RESISTANCE

CROSS REFERENCE TO RELATED DOCUMENT

The present application claims the benefit of Japanese Patent Application No. 2004-267098 filed on Sep. 14, 2004, the disclosure of which are totally incorporated herein by reference.

BACKGROUND OF THE INVENTION

1. Technical Field of the Invention

The present invention relates generally to a spark plug with increased durability and carbon fouling resistance for internal combustion engines which may be used in automotive vehicles, co-generation systems, or gas feed pumps.

2. Background Art

Japanese Patent No. 3140006 (U.S. Pat. No. 6,229,253 B1) teaches a multi-ground electrode spark plug for internal combustion engines. FIG. 12 shows a multi-ground electrode spark plug 9 of the same type.

The spark plug 9 includes a porcelain insulator 92, a center electrode 93 retained within the porcelain insulator 92, a metal shell 94 in which the porcelain insulator 92 is retained with an insulator head 921 exposed outside the metal shell 94, and a main ground electrode 951 defining a main spark gap 911 between itself and a tip 931 of the center electrode 93.

When the combustion temperature is extremely low in the engine, so that the temperature of the surface of the porcelain insulator 92 is hardly increased, it may cause the engine to smolder, so that a layer of carbon is deposited on the porcelain insulator 92, thereby resulting in a drop in insulation resistance between the center electrode 93 and the metal shell 94, which, in the worst case, leads to misfiring of the engine.

In order to avoid the above problem, the spark plug 9 also includes auxiliary ground electrodes 952 which are welded to the metal shell 94 and face the side surface of the center electrode 93 through the insulator nose 921 to define auxiliary spark gaps 912. When the carbon is deposited on the porcelain insulator 92, so that the insulation resistance between the center electrode 93 and the metal shell 94 drops, sparks are produced within the auxiliary spark gaps 912 to burn off the carbon deposit to clean up the surface of the porcelain insulator 92.

The spark plug 9 is so designed as to induce discharge of sparks in the auxiliary spark gaps 912 only when the engine is smoldering, so that a layer of carbon is deposited on the porcelain insulator 92 and to discharge sparks mostly in the main spark gap, thereby eliminating channeling (i.e., formation of channels, as illustrated in FIGS. 10 and 11, in the surface of the porcelain insulator 92 caused by the discharge of sparks in the auxiliary spark gaps 912) and minimizing the wear of the center electrode 93, as illustrated in FIG. 8, to enhance a carbon fouling resistance (i.e., anti-fouling characteristics) and a service life of the spark plug 9.

However, in modern internal combustion engines, an increase in compression ratio, supercharging, lean-burning, or an increase in amount of EGR results in an increased flow velocity of mixture within combustion chambers of the engine, which biases sparks toward the auxiliary spark gaps 912 to increase the rate of occurrence of sparks in the auxiliary spark gaps 912. This causes sparks to be discharged within the auxiliary spark gaps 912 even when the engine is not smoldering, thus accelerating the channeling and wear of the center electrode 93, which leads to a greatly decrease in service life of the spark plug 9.

Each of the auxiliary ground electrodes 952 structurally induces a strong electrical field at an edge 954 of an end face 953 closer to the metal shell 94, which may cause sparks to be discharged in the auxiliary spark gap 912 frequently when the porcelain insulator 92 is not fouled with carbon, thus accelerating the channeling and the wear of the center electrode 93.

The auxiliary ground electrode 952 may be shaped not to induce the strong electrical field. This, however, results in a decrease in spark in the auxiliary spark gaps 912 when the engine is smoldering, thus giving rise to a deterioration of carbon fouling resistance of the spark plug 9.

SUMMARY OF THE INVENTION

It is therefore a principal object of the invention to avoid the disadvantages of the prior art.

It is another object of the invention to provide an improved structure of a spark plug for internal combustion engines which is designed to have enhanced carbon fouling resistance and durability.

According to one aspect of the invention, there is provided a spark plug for an internal combustion engine which comprises: (a) a metal shell having a base end and a top end opposed to the base end in a lengthwise direction of the spark plug; (b) a hollow porcelain insulator having a length which includes a body and an insulator nose, the body being retained within the metal shell, the insulator nose projecting from the top end of the metal shell; (c) a center electrode retained within the porcelain insulator to have a top end protruding from the insulator nose; (d) a main ground electrode which defines a main spark gap between itself and the center electrode; and (e) an auxiliary ground electrode having a base end surface, a top end surface opposed to the base end surface, and an inner side surface extending between the base end surface and the top end surface. The base end surface is joined to the metal shell to orient the inner side surface to the center electrode. The inner side surface of the auxiliary ground electrode defines an auxiliary spark gap between itself and the insulator nose of the porcelain insulator so as to occupy a minimum distance between the porcelain insulator and the auxiliary ground electrode. The insulator nose of the porcelain insulator having a wall thickness T meeting a relation of 0.3 mm$\leqq$T$\leqq$0.7 mm.

The formation of the auxiliary spark gap between the inner side surface of the auxiliary ground electrode and the insulator nose serves to avoid a great local increase in electrical field strength on the auxiliary ground electrode, thereby minimizing excessive discharge within the auxiliary spark gap. Specifically, when the engine is not smoldering, the discharge of sparks within the auxiliary spark gaps are avoided, thus minimizing the channeling or the wear of the center electrode.

The wall thickness T of the insulator nose which is within a range of 0.7 mm or less serves to minimize an area of the porcelain insulator on which carbon is deposited, thereby enhancing the carbon fouling resistance of the spark plug. Specifically, the definition of the auxiliary spark gap by the inner side wall of the auxiliary ground electrode results in a decrease in frequency of sparks therewithin, but serves to meet a requirement to burn off carbon deposit through the sparks, thereby ensuring the carbon fouling resistance.

The wall thickness T of the insulator nose is also 0.3 mm or more, thereby ensuring desired mechanical strength of the porcelain insulator to minimize breakage of or cracks in the porcelain insulator during production thereof.

In the preferred mode of the invention, the inner side surface of the auxiliary ground electrode has an area which defines the auxiliary spark gap between itself and an outer peripheral side surface of the insulator nose of the porcelain insulator. The area has a length E in an axial direction of the porcelain insulator which meets a relation of $E \geqq 0.5$ mm. This facilitates ease of adjustment of the length of the auxiliary spark gap and enhance the service life of the spark plug without sacrificing the wear resistance of the auxiliary ground electrode.

The inner side surface of the auxiliary ground electrode may define the auxiliary spark gap between itself and an opposed top end corner of the insulator nose of the porcelain insulator. This enables the auxiliary spark gap to be located deep in a combustion chamber of the engine to enhance the ignitability of fuel in the engine.

The main spark gap has a length X. The auxiliary spark gap has a length Y. The lengths X and Y meet a relation of $X>Y$. This facilitates ease of discharge of sparks in the auxiliary spark gap when the engine is smoldering.

The lengths X and Y preferably meet relations of $X \leqq 0.9$ mm and $0.3 \text{ mm} \leqq Y \leqq X-0.1$ mm. This results in a decrease in voltage of electrical discharge in the main spark gap to enhance the voltage endurance of the porcelain insulator and the carbon fouling resistance of the spark plug.

A minimum distance D between a top end surface of the center electrode and the top end surface of the auxiliary ground electrode meets a relation of $D>T+Y$. This avoids sparks traveling between the center electrode and the auxiliary ground electrode without passing along the surface of the porcelain insulator to ensure the burning off of carbon deposits on the porcelain insulator by sparks generated in the auxiliary spark gap when the engine is smoldering.

The inner side surface of the auxiliary ground electrode has an area which defines the auxiliary spark gap between itself and the insulator nose of the porcelain insulator. A distance A between the top end of the metal shell and a top end of the center electrode along an axial direction of the spark plug and a distance C between the top end of the metal shell and a center of the area of the inner side surface of the auxiliary ground electrode in the axial direction of the spark plug have a relation of $A-C \leqq 3$ mm. This enhances the ignition of an air-fuel mixture in the engine by sparks generated in the auxiliary spark gap. Usually, the deeper the auxiliary spark gap are located in the combustion chamber of the engine, the better the ignition of the mixture by the sparks within the auxiliary spark gap will be. The dimensional relation of $A-C \leqq 3$ mm enables the auxiliary spark gap to be located deep inside the combustion chamber of the engine to enhance the ignitability of the mixture.

The center electrode and the main ground electrode may have noble metal chips opposed to each other to define the main spark gap. The noble metal chip of the center electrode has a transverse sectional area of 0.07 $mm^2$ to 0.64 $mm^2$, as extends in a direction perpendicular to an axial direction of the spark plug, and a height of 0.3 mm to 1.5 mm, as extends in the axial direction of the spark plug. The noble metal chip of the main ground electrode has a transverse sectional area of 0.12 $mm^2$ to 0.80 $mm^2$, as extends in a direction perpendicular to the axial direction of the spark plug, and a height of 0.3 mm to 1.5 mm, as extends in the axial direction of the spark plug. This minimizes the wear of the noble metal chips to ensure a desired service life of the spark plug and enhances the ignition of fuel in the engine.

The metal shell has a thread which has a thread diameter of M12 or less. This permits the spark plug to be made suitable in size for modern internal combustion engines and increases the design freedom of the engines, thereby permitting the size of valves of the engine to be increased or an engine cooling system to be improved mechanically. The M12 diameter of the thread also allows the amount of bending of the auxiliary ground electrode to be decreased, thus resulting in ease of machining of the auxiliary ground electrode. This minimizes the wear of the noble metal chips to ensure a desired service life of the spark plug and enhances the ignition of fuel in the engine.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENTS

Figure 1:
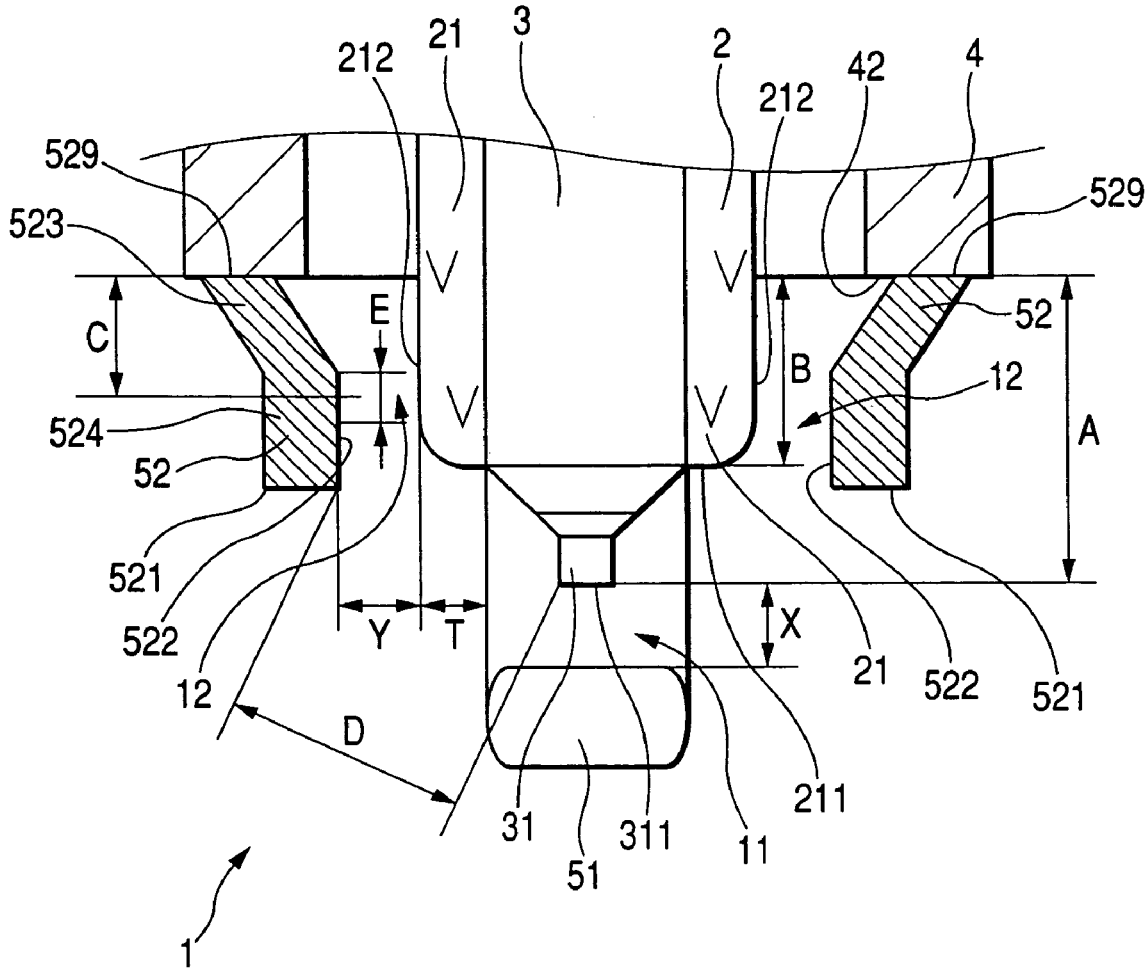
FIG. 1 is a partially longitudinal sectional view which shows a top portion of a spark plug according to the first embodiment of the invention.
Figure 2:
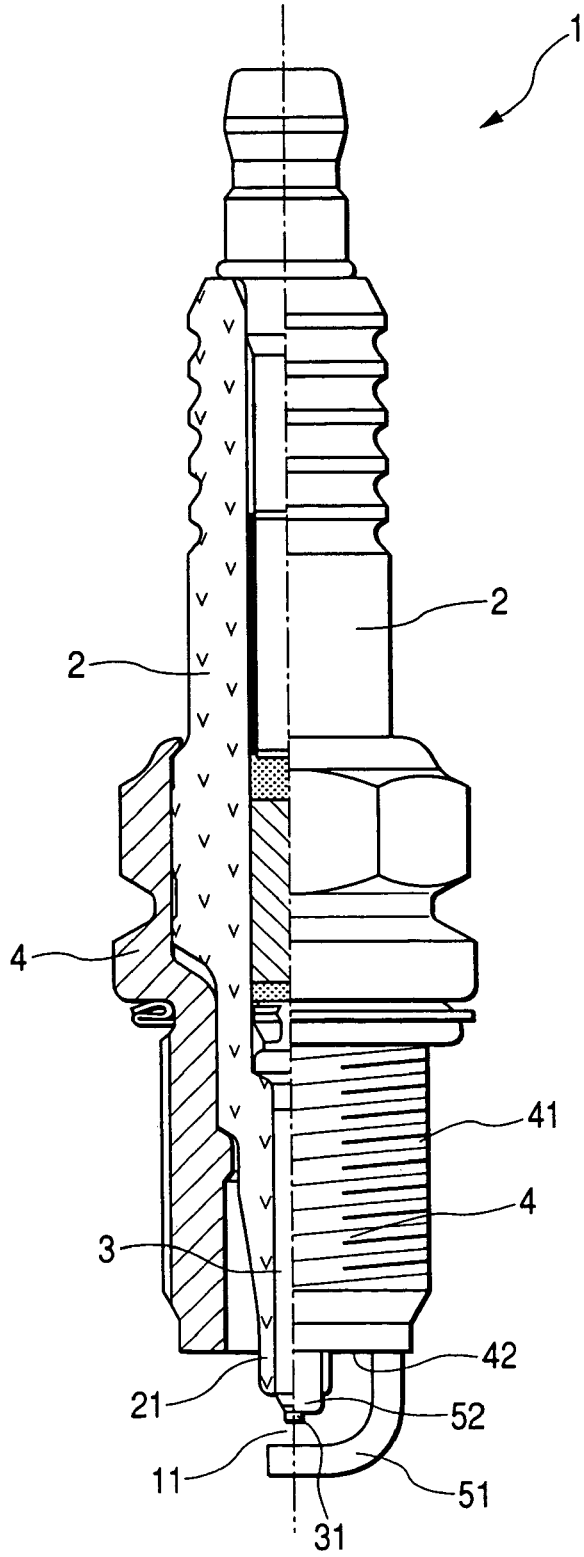
FIG. 2 is a partially sectional view which shows a spark plug according to the first embodiment of the invention.

Referring to the drawings, wherein like reference numbers refer to like parts in several views, particularly to FIGS. 1 and 2, there is shown a spark plug 1 for use in internal combustion engines according to the first embodiment of the invention.

The spark plug 1, as can be seen from FIG. 2, includes a hollow cylindrical metal shell 4, a porcelain insulator 2, and a center electrode 3. The metal shell 4 has formed on an outer periphery thereof a plug-installation thread 41 for installation of the spark plug 1 in the internal combustion engine. The porcelain insulator 2 is retained in the metal shell 4 and has a nose 21 projecting therefrom. The center electrode 3 is retained in the porcelain insulator 2 and has a tip 31 exposed outside the nose 21 of the porcelain insulator 2. The spark plug 1 also includes a main ground electrode 51 and auxiliary ground electrodes 52. The main ground electrode 51 is welded to the metal shell 4 and faces the tip 31 of the center electrode 3 to define a main spark gap 11. The auxiliary ground electrodes 52 are welded to the metal shell 4 and define auxiliary spark gaps 12 between themselves and the insulator nose 21.

Each of the auxiliary ground electrodes 52, as clearly illustrated in FIG. 2, has a base end 529, a top end 521 opposed to the base end 529, and an inner side wall 522 which faces the insulator nose 21 between the base end 529 and the top end 521.

Each of the auxiliary spark gaps 12 occupies a minimum distance between the porcelain insulator 2 and a corresponding one of the auxiliary ground electrodes 52 and is defined between the inner side wall 522 of the auxiliary ground electrode 52 and the insulator nose 21.

The insulator nose 21 has a wall thickness T which meets a relation of $0.3\ \text{mm} \leqq T \leqq 0.7\ \text{mm}$.

Each of the auxiliary spark gaps 12, as can be seen from FIG. 1, occupies between an outer side wall 212 of the insulator nose 21 and the inner side wall 522 of an opposite one of the auxiliary ground electrodes 52. If a length of a portion of the inner side wall 522 of each of the auxiliary ground electrodes 52 which extends parallel to a longitudinal center line of the spark plug 1 (i.e., an axis of the porcelain insulator 2 or center electrode 3) and forms the auxiliary spark gap 12 is defined as E, it is selected to meet a relation of $E \geqq 0.5\ \text{mm}$.

Each of the auxiliary ground electrodes 52 is made up of a slant section 523 and a parallel section 524. The slant section 523 extends from the metal shell 4 diagonally inwardly toward the center electrode 3. The parallel section 524 continues from the slant section 523 and extends parallel to the outer side wall 212 of the insulator nose 21. The parallel section 524 has the above described spark gap-forming area having the length E.

If the size of main spark gap 11, that is, the distance between the tip 31 of the center electrode 3 and the main ground electrode 51 is defined as X, and the distance of the auxiliary spark gaps 12 is defined as Y, they meet a relation of $X>Y$. The distances X and Y also satisfy relations of $X \leqq 0.9\ \text{mm}$ and $0.3\ \text{mm} \leqq Y \leqq X-0.1\ \text{mm}$.

If a minimum distance between a tip end 311 of the center electrode 3 and the top end 521 of each of the auxiliary ground electrodes 52 (i.e., the distance between the corner or edge of the tip end 311 and the inner edge of the top end 521) is defined as D, it is selected to meet a relation of $D>T+Y$.

If the distance between the top end 42 of the metal shell 4 and the tip end 311 of the center electrode 3 along the longitudinal center line of the spark plug 1 (or the center electrode 3) is defined as A, and the distance between the top end 42 and the center of an outer area of the porcelain insulator 3 forming the auxiliary spark gap 12 (i.e., the center of the spark gap-forming area of the inner side wall 522 of the auxiliary ground electrode 52) along the longitudinal center line of the spark plug 1 is defined as C, they are selected to meet a relation of $A-C \leqq 3\ \text{mm}$.

The thread 41 of the metal shell 4 has a thread diameter M12 (i.e., 12 mm) or less.

The two auxiliary ground electrodes 51 are, as can be seen from FIG. 1, welded to the metal shell 4 and opposed diametrically to each other across the center electrode 3. Only one or more than two auxiliary ground electrodes may alternatively be installed on the metal shell 4.

The beneficial advantages of the spark plug 1 will be described below.

Each of the auxiliary spark gaps 12 is, as described above, formed between the inner side wall 522 of one of the auxiliary ground electrodes 52 and the insulator nose 21, thereby avoiding a great local increase in electrical field strength on the auxiliary ground electrode 52 to minimize excessive discharge within the auxiliary spark gap 12. Specifically, when the engine is not smoldering, the discharge within the auxiliary spark gaps 12 are avoided. This minimizes the channeling or the wear of the peripheral side wall of the center electrode 3.

The wall thickness T of the nose 21 of the porcelain insulator 2 is 0.7 mm or less, thereby minimizing an area of the porcelain insulator 21 on which carbon is deposited which enhances carbon fouling resistance of the spark plug 1. Specifically, the auxiliary spark gaps 12 formed by the inner side walls 522 of the auxiliary ground electrodes 52 work to decrease the frequency of occurrence of sparks therewithin, but burn off the carbon deposits sufficiently using the sparks to ensure the carbon fouling resistance.

The wall thickness T of the nose 21 of the porcelain insulator 2 is 0.3 mm or more, thereby ensuring desired mechanical strength of the porcelain insulator 2 to minimize breakage of or cracks in the porcelain insulator 2 during production thereof.

The formation of the auxiliary spark gaps 12 between the outer side wall 212 of the insulator nose 21 and the inner side walls 522 of the auxiliary ground electrodes 52 facilitates ease of adjustment of the distance Y of the auxiliary spark gaps 12. The length E of the auxiliary spark gaps 12 along the longitudinal center line of the spark plug 1 is selected to be 0.5 mm or more, thereby ensuring the wear resistance of the auxiliary ground electrodes 52 and service life of the spark plug 1.

The distance X of the main spark gap 11 and the distance Y of the auxiliary spark gaps 12 are selected to meet the relation of $X>Y$, thereby facilitating discharge of sparks within the auxiliary spark gaps 12 when the engine is smoldering to enhance the carbon fouling resistance of the spark plug 1

The distances X and Y are also selected to satisfy relations of $X \leqq 0.9\ \text{mm}$ and $0.3\ \text{mm} \leqq Y \leqq X-0.1\ \text{mm}$, thereby decreasing the voltage of electrical discharge in the main spark gap 11 to enhance the voltage endurance of the porcelain insulator 2 and the carbon fouling resistance of the spark plug 1.

The minimum distance D between the tip end 311 of the center electrode 3 and the top end 521 of each of the auxiliary ground electrodes 52 is selected to meet a relation of $D>T+Y$, thereby avoiding sparks traveling between the center electrode 3 and the auxiliary ground electrode 52 without passing along the surface of the porcelain insulator 2 to ensure the burning off of carbon deposits on the porcelain insulator 2 by sparks generated in the auxiliary spark gaps 12 when the engine is smoldering.

The distance A between the top end 42 of the metal shell 4 and the tip end 311 of the center electrode 3 and the distance C between the top end 42 and the center of an outer area of the porcelain insulator 3 forming the auxiliary spark gap 12 are selected to meet a relation of $A-C \leqq 3\ \text{mm}$, thereby enhancing the ignition of an air-fuel mixture in the engine by sparks generated in the auxiliary spark gaps 12. Usually, the deeper the auxiliary spark gaps 12 are located in the combustion chamber of the engine, the better the ignition of the mixture by the sparks within the auxiliary spark gaps 12 will be. The dimensional relation of A−C≦3 mm enables the auxiliary spark gaps 12 to be located deep inside the combustion chamber of the engine to enhance the ignitability of the mixture.

The diameter of the thread 41 of the metal shell 4 is M12 (i.e., 12 mm) or less, thereby permitting the spark plug 1 to be made suitable in size for internal combustion engines. This increases the design freedom of internal combustion engines, thereby permitting the size of valves of the engine to be increased or an engine cooling system to be improved mechanically. The above diameter of the thread 41 allows the amount of bending of the auxiliary ground electrodes 52 to be decreased, thus resulting in ease of machining of the auxiliary ground electrodes 52.

Figure 3:
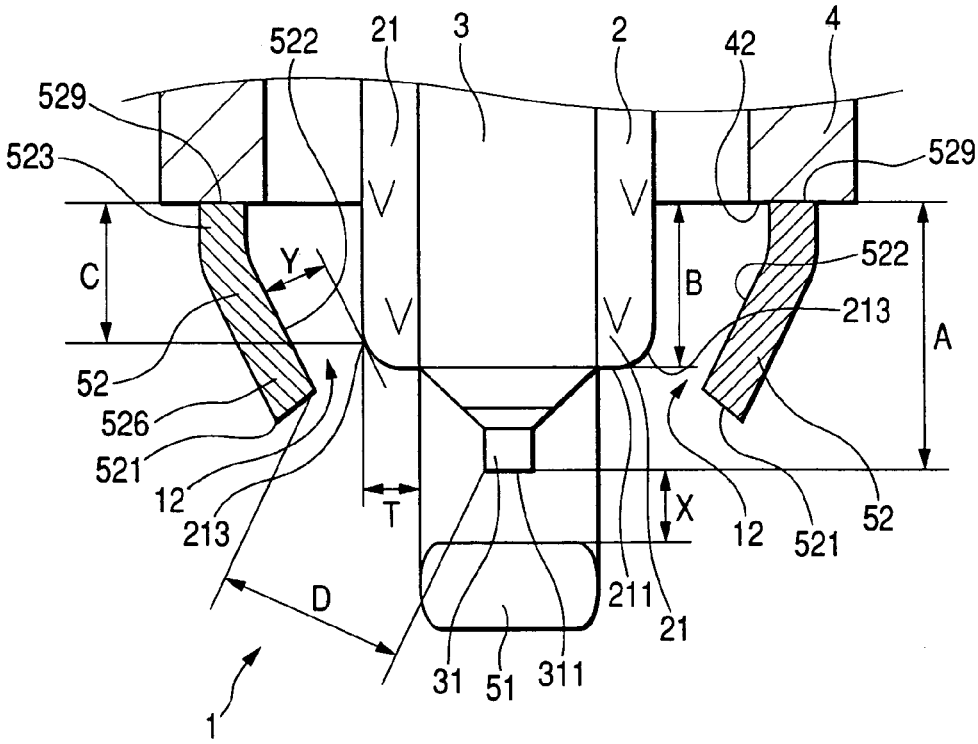
FIG. 3 is a partially longitudinal sectional view which shows a top portion of a spark plug according to the second embodiment of the invention.

FIG. 3 shows the spark plug 1 for internal combustion engines according to the second embodiment of the invention in which each of the auxiliary spark gaps 12 is defined by a curved top corner 213 of the porcelain insulator 2 and the inner side wall 522 of one of the auxiliary ground electrodes 52.

Each of the auxiliary ground electrodes 52 is made up of a parallel section 525 and a slant section 526. The parallel section 525 extends from the top end 42 of the metal shell 4 in parallel to the outer side wall 212 of the insulator nose 21. The slant section 526 continues from the parallel section 525 and is oriented diagonally inwardly toward the center electrode 3. The slant sections 526 form the auxiliary spark gaps 12 between themselves and the top corner 213 of the porcelain insulator 2. Other arrangements are identical with those in the first embodiment, and explanation thereof in detail will be omitted here.

The structure of the spark plug 1 of this embodiment enables the auxiliary spark gaps 12 to be located deep inside the combustion chamber of the engine to enhance the ignitability of the air-fuel mixture.

Figure 4:
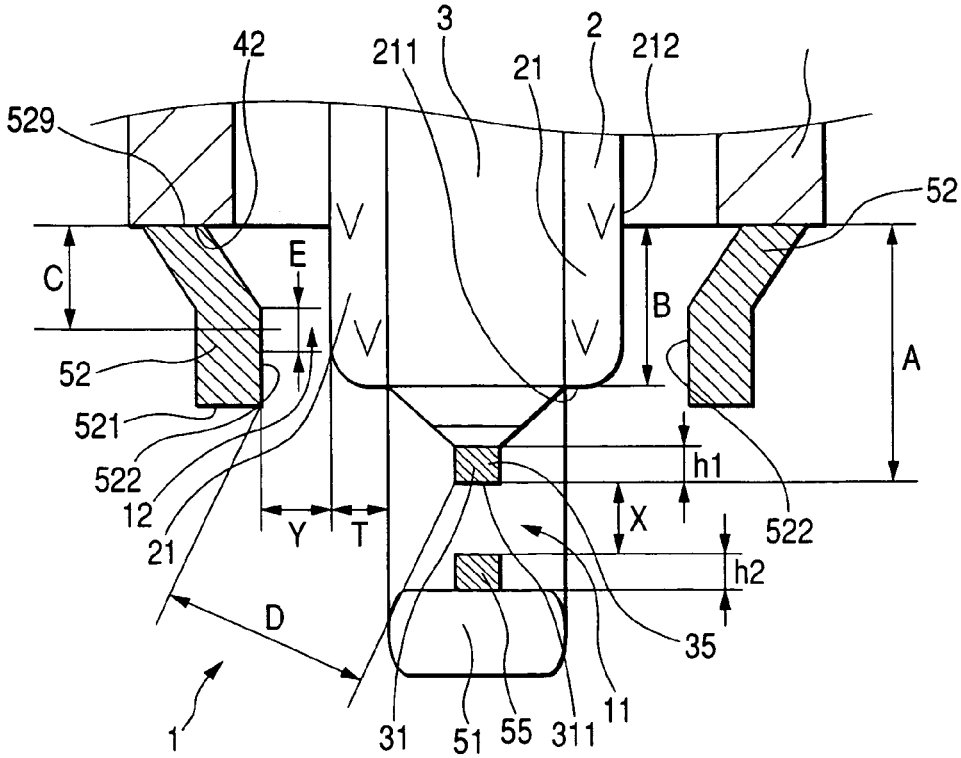
FIG. 4 is a partially longitudinal sectional view which shows a top portion of a spark plug according to the fourth embodiment of the invention.

FIG. 4 shows the spark plug 1 for internal combustion engines according to the third embodiment of the invention in which noble metal chips 35 and 55 are welded to the center electrode 3 and the main ground electrode 51 to define the main spark gap 11.

The noble metal chip 35 joined to the center electrode 3 has a transverse sectional area of 0.07 $mm^2$ to 0.64 $mm^2$ in a direction perpendicular to an axis thereof (i.e., the longitudinal center line of the center electrode 3) and a height h1 of 0.3 mm to 1.5 mm in an axial direction thereof (i.e., the lengthwise direction of the center electrode 3). The noble metal chip 55 joined to the main ground electrode 51 has a transverse sectional area of 0.12 $mm^2$ to 0.80 $mm^2$ in a direction perpendicular to an axis thereof and a height h2 of 0.3 mm to 1.5 mm in an axial direction thereof.

The noble metal chip 35 defines the tip end 311 of the center electrode 3. The main spark gap 11 is formed between the noble metal chips 35 and 55 and has the distance X, as described in the first embodiment.

The noble metal chip 35 is made from material which contains a main component of 50% or more by weight of Ir and at least one additive and has a melting point of 2000□C. or more. The additive is selected from among Pt, Rh, Ni, W, Pd, Ru, Re, Al, $Al_2O_3$, Y, and $Y_2O_3$.

The noble metal chip 55 is made from material which contains a main component of 50% or more by weight of Pt and at least one additive and has a melting point of 1500□C. or more. The additive is selected from among Pt, Rh, Ni, W, Pd, Ru, Re, Al, $Al_2O_3$, Y, and $Y_2O_3$.

Other arrangements are identical with those in the first embodiment, and explanation thereof in detail will be omitted here.

We performed tests to evaluate the carbon fouling resistance of the spark plug 1 in terms of the thickness T of the nose 21 of the porcelain insulator 2.

Figure 12:
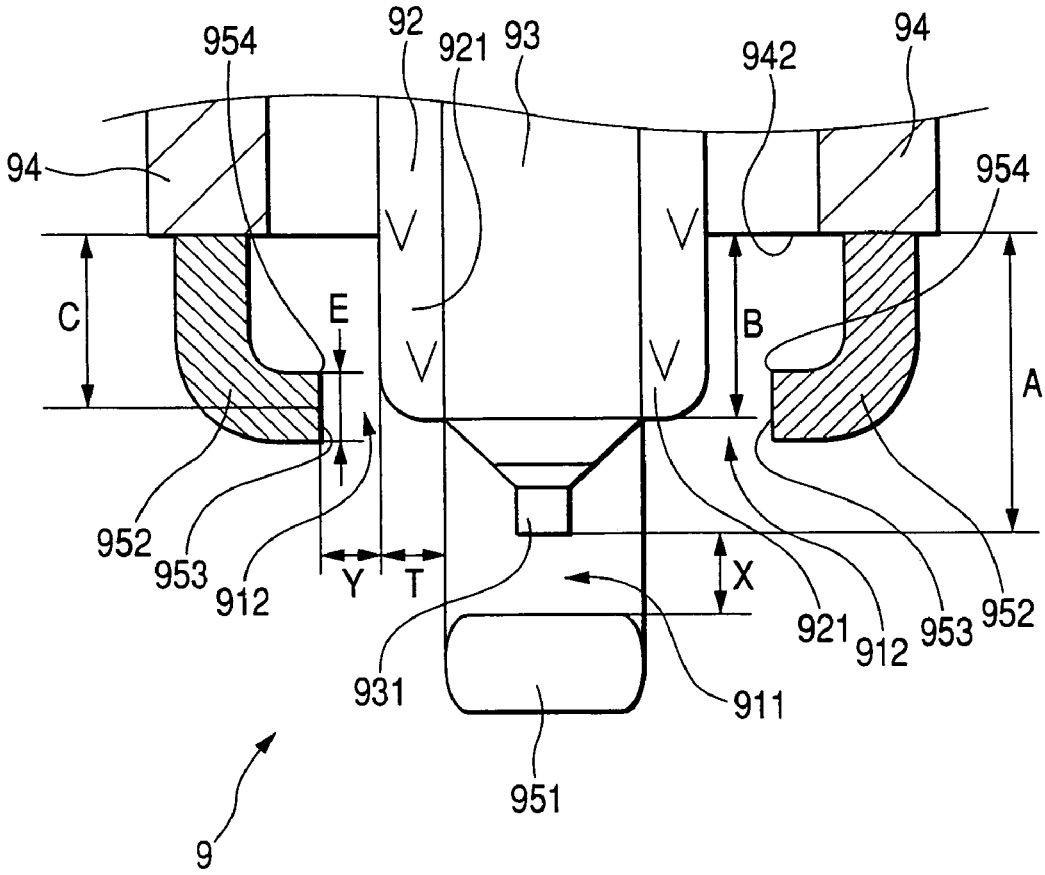
FIG. 12 (Prior Art)
FIG. 12 is a partially longitudinal sectional view which shows a top portion of a conventional spark plug.

We prepared plug samples which were identical in structure with the spark plug 1 of FIG. 1 in that the auxiliary spark gaps 12 are formed between the insulator nose 21 and the inner side walls 522 of the auxiliary ground electrodes 52 and had different values of 0.5 mm, 0.7 mm, 0.9 mm, and 1.0 mm in the wall thickness T of the insulator nose 21. We also prepared comparative plug samples which were identical in structure with the spark plug 9, as illustrated in FIG. 12, in that the auxiliary spark gaps 912 are formed between the top ends 953 of the auxiliary ground electrodes 952 and the insulator nose 921 and 1.0 mm in the wall thickness T of the insulator nose 921.

Each of the samples had the above described dimensions X=1.0 mm, Y=0.5 mm, A=4.5 mm, B=3.0 mm, C=2.25 mm, D=2.45 mm, and E=0.7 mm. However, in each of the comparative plug samples, the width E of the top end 953 is 1.1 mm in an axial direction of the metal shell 94. The distance C between the top end 942 of the metal shell 94 and the center of the top end 953 of each of the auxiliary ground electrodes 952 in the axial direction of the metal shell 94 were 3.0 mm.

The distance B is a distance between the top end 942 of the metal shell 4 and the top end 211 of the porcelain insulator 2.

The tests were conducted using a direct injection engine in conformity to low-temperature smoldering fouling test procedures, as specified by JIS (Japanese Industrial Standards) D 1606 (Adaptability test code of spark plugs for automobiles). The evaluations of each sample were made in terms of the appearance of the insulator nose 21 (i.e., the degree to which carbon deposits are cleaned up from the insulator nose 21), the insulation resistance between the center electrode 3 and the metal shell 4, and the drivability (e.g., combustion conditions of the engine).

Results of the evaluations are demonstrated in table 1 below.

TABLE 1

| | | Wall Thickness T (mm) | | | |
|---|---|---|---|---|---|
| | | 0.5 | 0.7 | 0.9 | 1.0 |
| Carbon fouling resistance | Appearance | ○ | ○ | Δ | X |
| | Insulation Resistance | ○ | ○ | Δ | X |
| | Drivability | ○ | ○ | ○ | Δ |

In table 1, "○" indicates the plug sample which is better in one of the evaluation parameters than the comparative ones. "Δ" indicates the plug sample which is substantially equivalent to the comparative ones. "X" indicates the plug sample not better than the comparative ones.

The table 1 shows that when the wall thickness T is 0.7 mm or less, the plug samples are superior in any of the evaluation parameters to the comparative plug samples and have enhanced carbon fouling resistance. When T=1.0 mm or 0.9 mm, an increase in difficulty in producing sparks within the auxiliary spark gaps 12 is considered to arise from elimination of a greater field strength area from the auxiliary ground electrode 52 by the formation of the auxiliary spark gap 12 by the inner side wall 522 of the auxiliary ground electrode 52, so that the plug samples are not superior in the carbon fouling resistance to the comparative plug samples in which the auxiliary ground electrodes 52 have the greater field strength area.

It is, therefore, appreciated that when T≦0.7 mm, the carbon fouling resistance is enhanced as compared with that in the comparative plug samples.

We also performed tests to evaluate the ignitability of fuel in the engine by sparks produced within the auxiliary spark gaps 12 in terms of the distance A between the top end 42 of the metal shell 4 and the tip end 311 of the center electrode 3 and the distance C between the top end 42 and the center of the outer area of the porcelain insulator 3 forming the auxiliary spark gap 12.

We prepared plug samples which were identical in structure with the spark plug 1 of FIG. 1 and in which A=4.5 mm, and C=3.0 mm, 2.0 mm, 1.5 mm, and 1.0 mm. The plug samples also had different values of the distance B which meet a relation of B−C=0.75 mm. Other dimensions were identical with those in the plug samples as used in the above first experiment.

The tests were conducted in conformity to low-temperature smoldering fouling test procedures, as specified by JIS D 1606. We observed the waveform of voltage of spark discharges in each sample using an oscilloscope and broken down the spark discharges into those produced in the main spark gap 11 and those produced in the auxiliary spark gaps 12. We measured a variation in combustion in the engine in which each plug sample was installed. Results of the measurement are plotted in FIG. 5.

Figure 5:
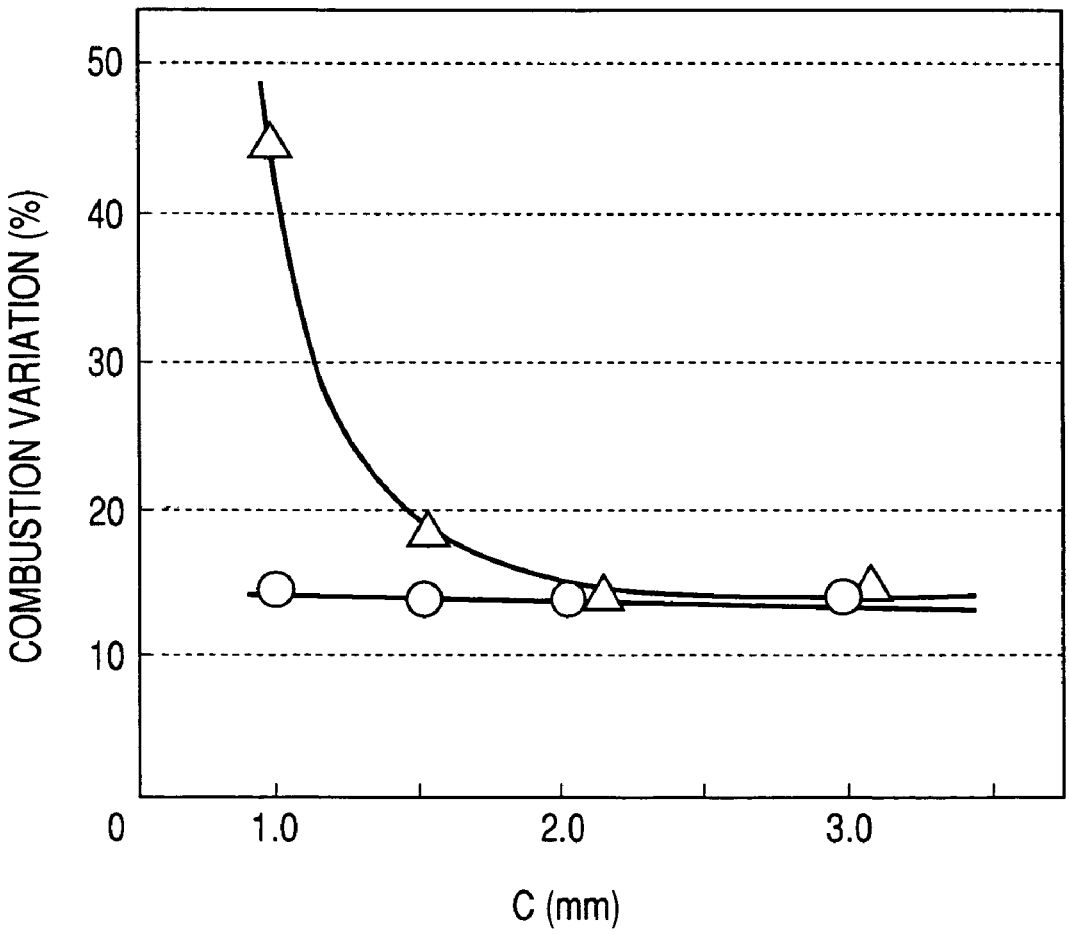
FIG. 5 is a graph which demonstrates an experimentally obtained relation between a variation in combustion of an engine and a distance C of the spark plug, as illustrated in FIG. 1.

In FIG. 5, "○" indicates the variation in combustion resulting from the spark discharges produced in the main spark gap 11. "Δ" indicates the variation in combustion resulting from the spark discharges produced in the auxiliary spark gaps 12. The variation in combustion is expressed by (standard deviation/mean effective pressure)×100.

The graph of FIG. 5 shows that when the distance C is 1.5 mm or more, that is, when A−C≦3 mm, the variations in combustion arising from the spark discharges produced in the main spark gap 11 and the auxiliary spark gaps 12 will be substantially identical with each other, and the plug samples will provide the same ignitability of fuel.

We also performed tests to measure the percentage at which sparks travel to and fly within the auxiliary spark gaps 12 of the spark plug 1 in FIG. 1 when the engine is smoldering in terms of a relation between the distance X of the main spark gap 11 and the distance Y of the auxiliary spark gaps 12.

In the tests, we run the engine at full throttle at 1200 rpm and at closed throttle cyclically to have the engine smolder intentionally to produce an insulation resistance of 10M Ω and observed smoldering conditions of the engine. Afterwards, we run the engine at 800 rpm and measured the frequency of occurrence of sparks in the main spark gap 11 and the frequency of occurrence of sparks in the auxiliary spark gaps 12 in the same manner as that in the above second experiment. Results of the measurement are demonstrated in FIG. 6.

Figure 6:
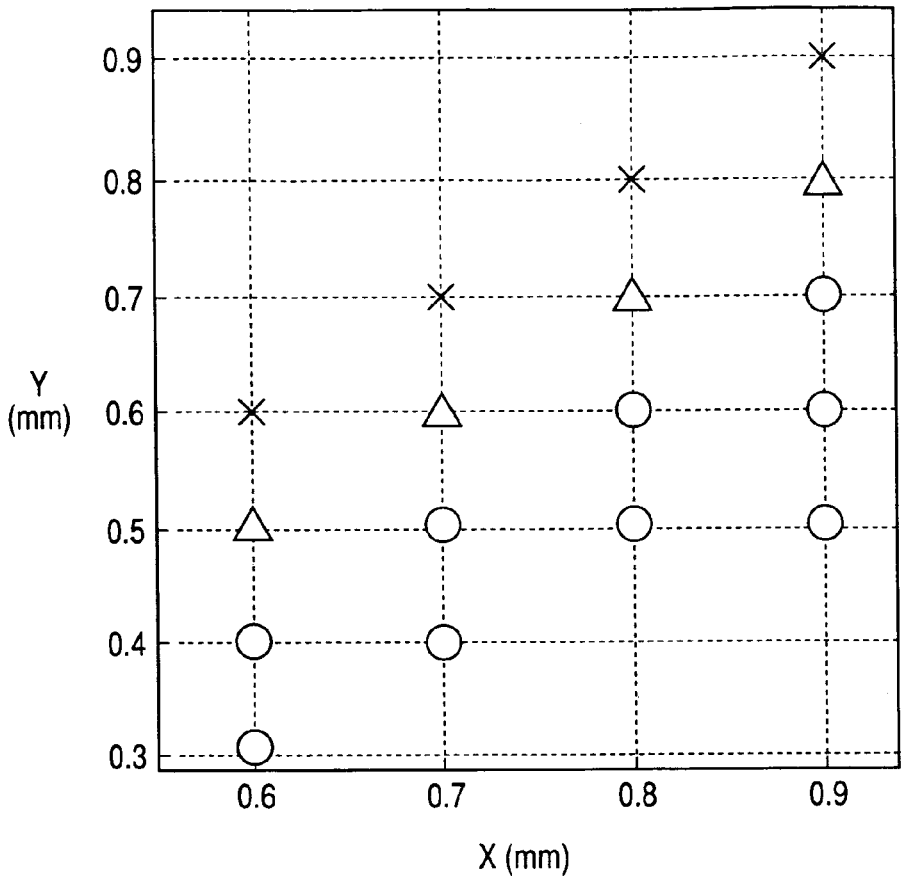
FIG. 6 is a graph which demonstrates an experimentally obtained relation between distances X and Y of the spark plug, as illustrated in FIG. 1.

In FIG. 6, "○" indicates the plug sample in which 80% or more of sparks traveled to and flied within the auxiliary spark gaps 12. "Δ" indicates the plug sample in which 50% to 80% of sparks traveled to and flied within the auxiliary spark gaps 12. "X" indicates the plug sample in which less than 50% of sparks traveled to and flied within the auxiliary spark gaps 12.

The graph of FIG. 6 shows that when Y≦X−0.1 mm, a sequence of sparks will fly within the auxiliary spark gaps 12 at a desired percentage, and when Y≦X−0.2 mm, it results in an increased possibility of sparks flying to the auxiliary spark gaps 12.

We also performed tests to observe the wear of the peripheral surface of the center electrode 3 and the channeling.

We prepared two types of plug samples: one is identical in structure with the spark plug 1 of FIG. 1, and the other is identical in structure with the prior art spark plug 9, as illustrated in FIG. 12. The plug samples had dimensions, as listed in table 2 below.

TABLE 2

| Dimension | Spark plug of the invention | Prior art spark plug |
|---|---|---|
| X | 0.9 | 1.1 |
| Y | 0.5 | 0.5 |
| T | 0.7 | 1.0 |
| A | 4.5 | 4.5 |
| B | 3.0 | 3.0 |
| C | 2.25 | 3.0 |
| D | 2.45 | 2.8 |
| E | 0.7 | 1.1 |

Figure 7:
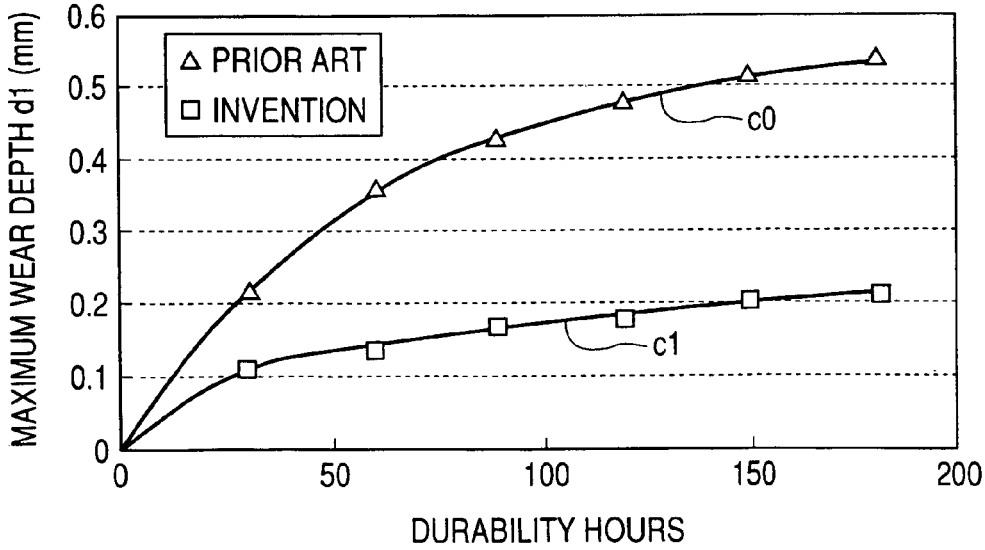
FIG. 7 is a graph which demonstrates experimentally obtained relations between a maximum wear depth d1 and durability hours in the spark plug, as illustrated in FIG. 1, and a prior art spark plug.
Figure 8:
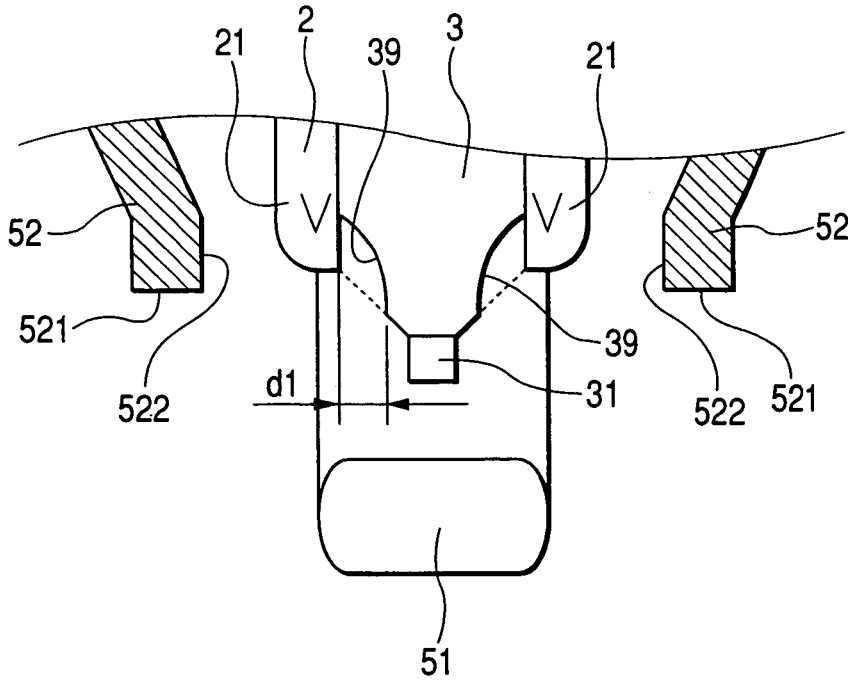
FIG. 8 is an explanatory view which shows the wear of a center electrode of a spark plug test sample.

FIG. 7 is a graph representing results of evaluation of the wear of the peripheral surface of the center electrodes 3 and 93 of the plug samples. FIG. 8 illustrates the wear of the plug samples identical in structure with the one of FIG. 1.

We conducted the tests using a 2500 cc six-cylinder high-flow rate engine equipped with a supercharger. We run the engine at full throttle at 5600 rpm to produce conditions facilitating the ease with which sparks are discharged in the auxiliary spark gaps 12 and 912 and measure a maximum wear depth d1, as illustrated in FIG. 8, every 30 hours for 180 hours. The maximum wear depth d1 is a maximum depth of a worn recess of the center electrodes 3 and 93.

In FIG. 7, a curve c0 extending through plots "Δ" indicates the wear depth of the prior art plug samples. A curve c1 extending through plots "□" indicates the wear depth of the plug samples identical in structure of the one in FIG. 1.

The graph of FIG. 7 shows that when the spark plug 1 is very small in the wear depth d1.

Figure 9:
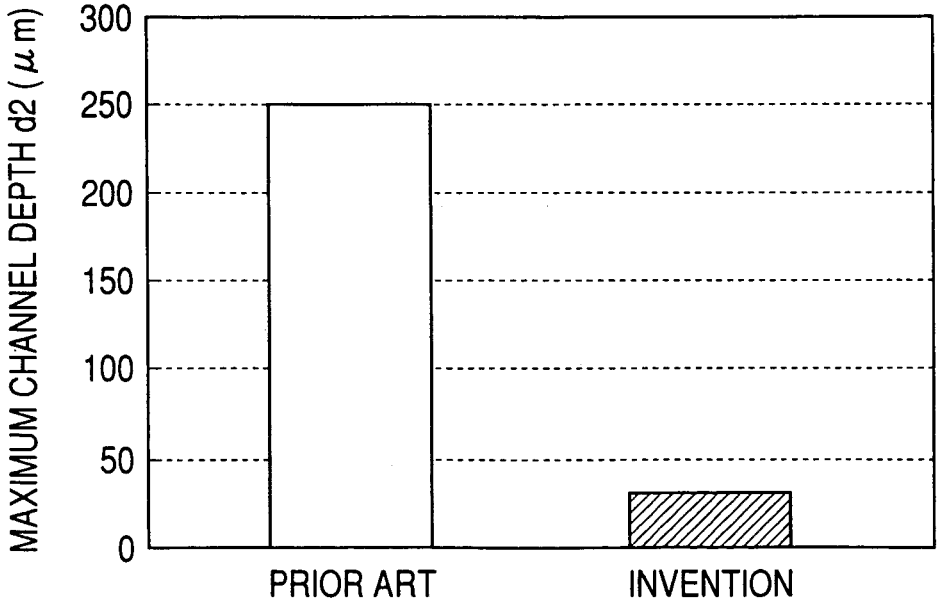
FIG. 9 is a graph which shows a comparison between depths of channels formed in center electrodes of the spark plug of FIG. 1 and a prior art spark plug.

FIG. 9 is a graph representing results of evaluation of the channeling occurring at the porcelain insulators 2 and 92 of the spark plugs 1 and 9.

Figure 10:
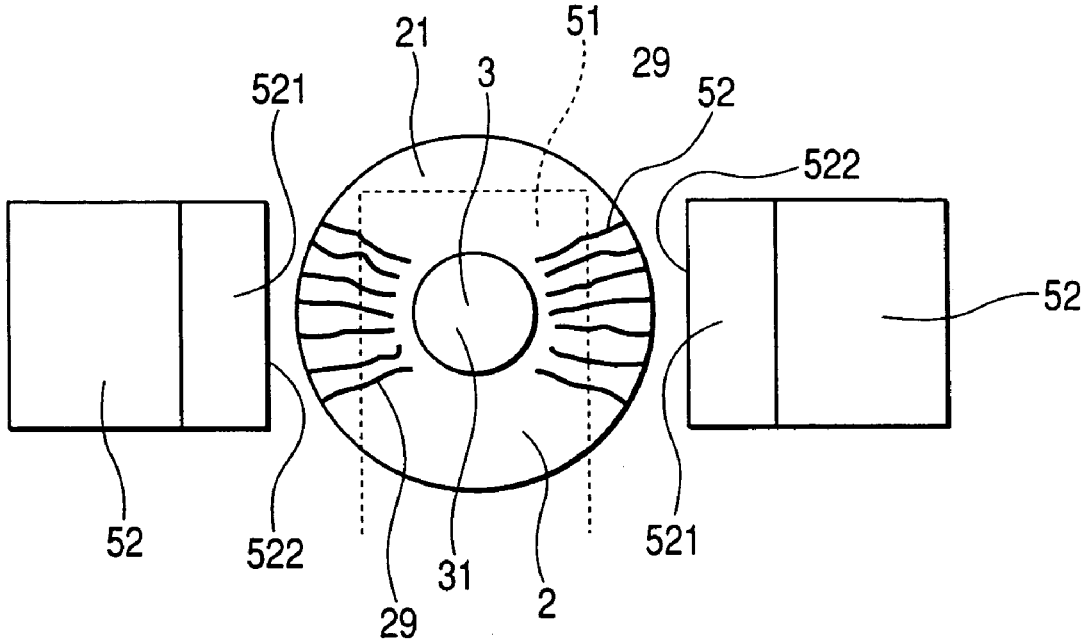
FIG. 10 is a top view which shows channels formed in a center electrode of a spark plug test sample.

We conducted the tests using a 2500 cc six-cylinder high-flow rate engine equipped with a supercharger. We run the engine at 3600 rmp at 80% throttle to induce the formation of channels 29, as illustrated in FIGS. 10 and 11, and measured a maximum depth d2 of the channels 29 after 400 hours.

Figure 11:
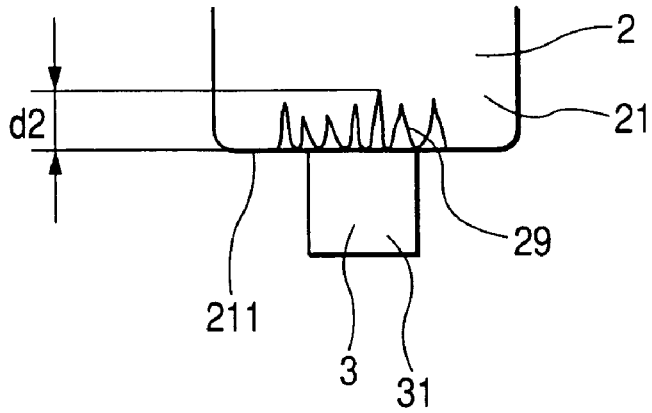
FIG. 11 is a side view of FIG. 10.

The maximum depth d2 of the channels 29 is, as clearly shown in FIG. 11, a maximum distance between the top end 211 of the insulator nose 21 and the bottom of the channels.

The graph of FIG. 9 shows that the spark plug 1 is very small in the depth of the channels 29.

We also conducted the same tests, as described above, on plug samples identical in structure with the one in FIG. 3 in which the auxiliary spark gaps 12 are formed between the inner side walls 522 of the auxiliary ground electrodes 52 and the top corner 213 of the porcelain insulator 2 and found substantially the same results. The plug samples used in this experiment were identical in dimensions with those used in the above first to fourth experiments except for the distance E.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments witch can be embodied without departing from the principle of the invention as set forth in the appended claims.

What is claimed is:

1. A spark plug for an internal combustion engine comprising:

a metal shell having a base end and a top end opposed to the base end in a lengthwise direction of the spark plug;

a hollow porcelain insulator having a length which includes a body and an insulator nose, the body being retained within said metal shell, the insulator nose projecting from the top end of said metal shell;

a center electrode retained within said porcelain insulator to have a top end protruding from the insulator nose;

a main ground electrode which defines a main spark gap between itself and said center electrode; and an auxiliary ground electrode having a base end surface, a top end surface opposed to the base end surface, and an inner side surface extending between the base end surface and the top end surface, the base end surface engaging and directly being joined to said metal shell to orient the inner side surface to said center electrode, wherein the inner side surface of said auxiliary ground electrode defines an auxiliary spark gap between itself and the insulator nose of said porcelain insulator so as to occupy a minimum distance between said porcelain insulator and said auxiliary ground electrode, wherein the insulator nose of said porcelain insulator has a wall thickness T meeting a relation of 0.3 mm$\leqq$T$\leqq$0.7 mm, and wherein the inner side surface of said auxiliary ground electrode has an area which defines the auxiliary spark gap between itself and an outer peripheral side surface of the insulator nose of said porcelain insulator, the area having a length E in an axial direction of said porcelain insulator which meets a relation of E$\geqq$0.5 mm.

2. A spark plug as set forth in claim 1, wherein the main spark gap has a length X, and the auxiliary spark gap has a length Y, the lengths X and Y meeting a relation of X>Y.

3. A spark plug as set forth in claim 2, wherein the lengths X and Y also meet relations of X$\leqq$0.9 mm and 0.3 mm$\leqq$Y$\leqq$X−0.1 mm.

4. A spark plug as set forth in claim 1, wherein a minimum distance D between a top end surface of said center electrode and the top end surface of said auxiliary ground electrode meets a relation of D>T+Y.

5. A spark plug as set forth in claim 1, wherein the inner side surface of said auxiliary ground electrode has an area which defines the auxiliary spark gap between itself and the insulator nose of said porcelain insulator, and a distance A between the top end of said metal shell and a top end of said center electrode along an axial direction of the spark plug and a distance C between the top end of said metal shell and a center of the area of the inner side surface of said auxiliary ground electrode in the axial direction of the spark plug have a relation of A−C$\leqq$3 mm.

6. A spark plug as set forth in claim 1, wherein said center electrode and said main ground electrode have noble metal chips opposed to each other to define the main spark gap, the noble metal chip of said center electrode having a transverse sectional area of 0.07 $mm^2$ to 0.64 $mm^2$, as extends in a direction perpendicular to an axial direction of the spark plug, and a height of 0.3 mm to 1.5 mm, as extends in the axial direction of the spark plug, the noble metal chip of said main ground electrode having a transverse sectional area of 0.12 $mm^2$ to 0.80 $mm^2$, as extends in a direction perpendicular to the axial direction of the spark plug, and a height of 0.3 mm to 1.5 mm, as extends in the axial direction of the spark plug.

7. A spark plug as set forth in claim 1, wherein said metal shell has a threaded portion formed on an outer periphery thereof which has a thread diameter of M12 or less.

8. A spark plug as set forth in claim 1, wherein said auxiliary ground electrode includes a slant section and a parallel section, the parallel section being defined to extend in parallel to a plane of an outer side wall of the insulator nose and the slant section extending in a direction diagonally inwardly toward an axis of said center electrode.

9. A spark plug as set forth in claim 1, wherein said auxiliary ground electrode includes a slant section and a parallel section, the slant section extending from the base end surface diagonally inwardly toward said center electrode, the parallel section extending parallel to an outer side wall of the insulator nose.

10. A spark plug as set forth in claim 1, wherein said auxiliary ground electrode includes a parallel section and a slant section, the parallel section extending from a top end of said metal shell in parallel to an outer side wall of the insulator nose, the slant section continuing from the parallel section and being oriented diagonally inwardly toward said center electrode, wherein the auxiliary spark gap is defined between the slant section and a top corner of the insulator nose of said porcelain insulator.

11. A spark plug for an internal combustion engine comprising:

a metal shell having a base end and a top end opposed to the base end in a lengthwise direction of the spark plug;

a hollow porcelain insulator having a length which includes a body and an insulator nose, the body being retained within said metal shell, the insulator nose projecting from the top end of said metal shell;

a center electrode retained within said porcelain insulator to have a top end protruding from the insulator nose;

a main around electrode which defines a main spark gap between itself and said center electrode;

an auxiliary ground electrode having a base end surface, a top end surface opposed to the base end surface, and an inner side surface extending between the base end surface and the top end surface, the base end surface engaging and directly being joined to said metal shell to orient the inner side surface to said center electrode, wherein the inner side surface of said auxiliary ground electrode defines an auxiliary spark gap between itself and the insulator nose of said porcelain insulator so as to occupy a minimum distance between said porcelain insulator and said auxiliary ground electrode, wherein the insulator nose of said porcelain insulator has a wall thickness T meeting a relation of 0.3 mm$\leqq$T$\leqq$0.7 mm, and wherein the inner side surface of said auxiliary ground electrode defines the auxiliary spark gap between itself and an opposed top end corner of the insulator nose of said porcelain insulator.

12. A spark plug as set forth in claim 11, wherein the main spark gap has a length X, and the auxiliary spark gap has a length Y, the lengths X and Y meeting a relation of X>Y.

13. A spark plug as set forth in claim 12, wherein the lengths X and Y also meet relations of $X \leqq 0.9$ mm and 0.3 mm$\leqq Y \leqq X-0.1$ mm.

14. A spark plug as set forth in claim 11, wherein a minimum distance D between a top end surface of said center electrode and the top end surface of said auxiliary ground electrode meets a relation of $D>T+Y$.

15. A spark plug as set forth in claim 11, wherein the inner side surface of said auxiliary ground electrode has an area which defines the auxiliary spark gap between itself and the insulator nose of said porcelain insulator, and a distance A between the top end of said metal shell and a top end of said center electrode along an axial direction of the spark plug and a distance C between the top end of said metal shell and a center of the area of the inner side surface of said auxiliary ground electrode in the axial direction of the spark plug have a relation of $A-C \leqq 3$ mm.

16. A spark plug as set forth in claim 11, wherein said center electrode and said main ground electrode have noble metal chips opposed to each other to define the main spark gap, the noble metal chip of said center electrode having a transverse sectional area of 0.07 $mm^2$ to 0.64 $mm^2$, as extends in a direction perpendicular to an axial direction of the spark plug, and a height of 0.3 mm to 1.5 mm, as extends in the axial direction of the spark plug, the noble metal chip of said main ground electrode having a transverse sectional area of 0.12 $mm^2$ to 0.80 $mm^2$, as extends in a direction perpendicular to the axial direction of the spark plug, and a height of 0.3 mm to 1.5 mm, as extends in the axial direction of the spark plug.

17. A spark plug as set forth in claim 11, wherein said metal shell has a threaded portion formed on an outer periphery thereof which has a thread diameter of M12 or less.

18. A spark plug as set forth in claim 11, wherein said auxiliary ground electrode includes a slant section and a parallel section, the parallel section being defined to extend in parallel to a plane of an outer side wall of the insulator nose and the slant section extending in a direction diagonally inwardly toward an axis of said center electrode.

19. A spark plug as set forth in claim 11, wherein said auxiliary ground electrode includes a parallel section and a slant section, the parallel section extending from a top end of said metal shell in parallel to an outer side wall of the insulator nose, the slant section continuing from the parallel section and being oriented diagonally inwardly toward said center electrode, wherein the auxiliary spark gap is defined between the slant section and a top corner of the insulator nose of said porcelain insulator.

* * * * *